US006853733B1

(12) United States Patent
Groothedde et al.

(10) Patent No.: US 6,853,733 B1
(45) Date of Patent: Feb. 8, 2005

(54) TWO-WIRE INTERFACE FOR DIGITAL MICROPHONES

(75) Inventors: Wouter Groothedde, Almere (NL); Eric Antonius Maria Klumperink, Lichtenvoorde (NL); Bram Nauta, Borne (NL); Rudolphe Gustave Hubertus Eschauzier, Bergschenhoek (NL); Nico van Rijn, Katwijk (NL)

(73) Assignee: National Semiconductor Corporation, Santa Clara, CA (US)

( * ) Notice: Subject to any disclaimer, the term of this patent is extended or adjusted under 35 U.S.C. 154(b) by 47 days.

(21) Appl. No.: 10/465,514

(22) Filed: Jun. 18, 2003

(51) Int. Cl.[7] ..... H04R 3/00
(52) U.S. Cl. ..... 381/111; 381/113; 381/122
(58) Field of Search ..... 381/111, 112, 381/113, 114, 91, 92, 122, 174, 190, 191; 398/132, 133

(56) References Cited

U.S. PATENT DOCUMENTS 4,422,182 A * 12/1983 Kenjyo ..... 398/132
5,619,583 A * 4/1997 Page et al. ..... 381/172
6,125,189 A * 9/2000 Yasuno et al. ..... 381/111
6,285,769 B1 * 9/2001 Edelson et al. ..... 381/95
6,449,370 B1 * 9/2002 Yasuno et al. ..... 381/71.6
6,549,631 B1 * 4/2003 Jackson ..... 381/111
6,697,493 B1 * 2/2004 Kern ..... 381/111
6,721,429 B1 * 4/2004 Akamatsu et al. ..... 381/122
6,731,763 B1 * 5/2004 Dent ..... 381/114
2003/0059060 A1 * 3/2003 Eastty et al. ..... 381/91
2004/0122541 A1 * 6/2004 DiSanza et al. ..... 700/94

OTHER PUBLICATIONS

Amplifiers.National.com, "Analog and Digital ECM Microphones," *National Semiconductor*, web article, 2 pages.
Arie Van Rhijn, "Integrated Circuits for High Performance Electret Microphones," *National Semiconductor*, web article Dec. 2002, 5 pages.
Arie Van Rhijn, "Digital Microphones–Applications and System Partitioning," *National Semiconductor*, web article Apr. 2003, 6 pages.

* cited by examiner

*Primary Examiner*—Xu Mei
*Assistant Examiner*—Laura A. Grier
(74) *Attorney, Agent, or Firm*—Merchant & Gould PC

(57) ABSTRACT

A two-wire interface for a digital microphone circuit includes a power line and a ground line. The interface utilizes the ground line as a "voltage active line" to transmit both clock and data signals between the digital microphone circuit and a receiving circuit. The digital microphone circuit detects the clock signal on the voltage active line and uses the detected clock signal to operate an ADC to provide digital data. The digital data is used to selectively drive current back to the receiving circuit over the voltage active line. The receiving circuit detects the transmitted data by monitoring the voltage associated with a line termination. The impedance associated with the line termination is switched by the receiver circuit to modulate the clock signal on the voltage active line.

20 Claims, 9 Drawing Sheets

TWO-WIRE INTERFACE FOR DIGITAL MICROPHONES

FIELD OF THE INVENTION

The present invention is related to microphone interfaces. More particularly, the present invention is related to a system and method that utilizes two wires to interface a digital microphone to another device, where one wire is used for power and the other wire is used as a voltage active line for duplex communications.

BACKGROUND OF THE INVENTION

Sound is often described as a moving pressure wave. A sound source is a moving object that creates a change in air pressure as the object moves. Air particles that are adjacent to the sound source begin to move as a result in the change in air pressure. Each subsequent moving air particle creates a change in air pressure to other adjacent air particles resulting in a moving pressure wave. Microphones are devices that are arranged to measure variations in air pressure and convert those pressure variations into electrical signals.

Many different technologies are commonly used to accomplish the conversion of air pressure into an electric signal. One particular type of technology is referred to as a condenser microphone. A condenser microphone is essentially a capacitive device, where one plate of the capacitor moves in response to sound waves. The movement in the plate results in a change in capacitance value of the capacitor. The capacitive changes are amplified to create a measurable signal that is typically an analog voltage. Condenser microphones usually need a small battery to provide a voltage across the capacitor plates.

An electret microphone (ECM) is a variant of a condenser microphone. In one type of ECM, a permanently charged diaphragm is placed over a conductive metal back-plate. In another type of ECM, a charged back-plate is used instead of a charged diaphragm. Recently, ECMs have been combined with various electronic circuits to provide digital output signals instead of an analog voltage.

An example digital ECM is illustrated in FIG. 1. The digital ECM includes a diaphragm that is separated from an electret by an air-gap. The Electret includes a back-plate that is electrically connected to a power supply (VCC). The variations in the capacitance of the ECM are processed by an integrated circuit. The integrated circuit includes a preamplifier that amplifies the signal levels from the ECM, and an analog-to-digital converter (ADC) that converts the amplified signal levels to a digital signal. The integrated circuit requires a power signals (VCC, GND), and a clock signal (Clock-In), to provide the digital output (Data-Out).

BRIEF DESCRIPTION OF THE DRAWINGS

Non-limiting and non-exhaustive embodiments of the present invention are described with reference to the following drawings.

DETAILED DESCRIPTION OF THE PREFERRED EMBODIMENT

Figure 1:
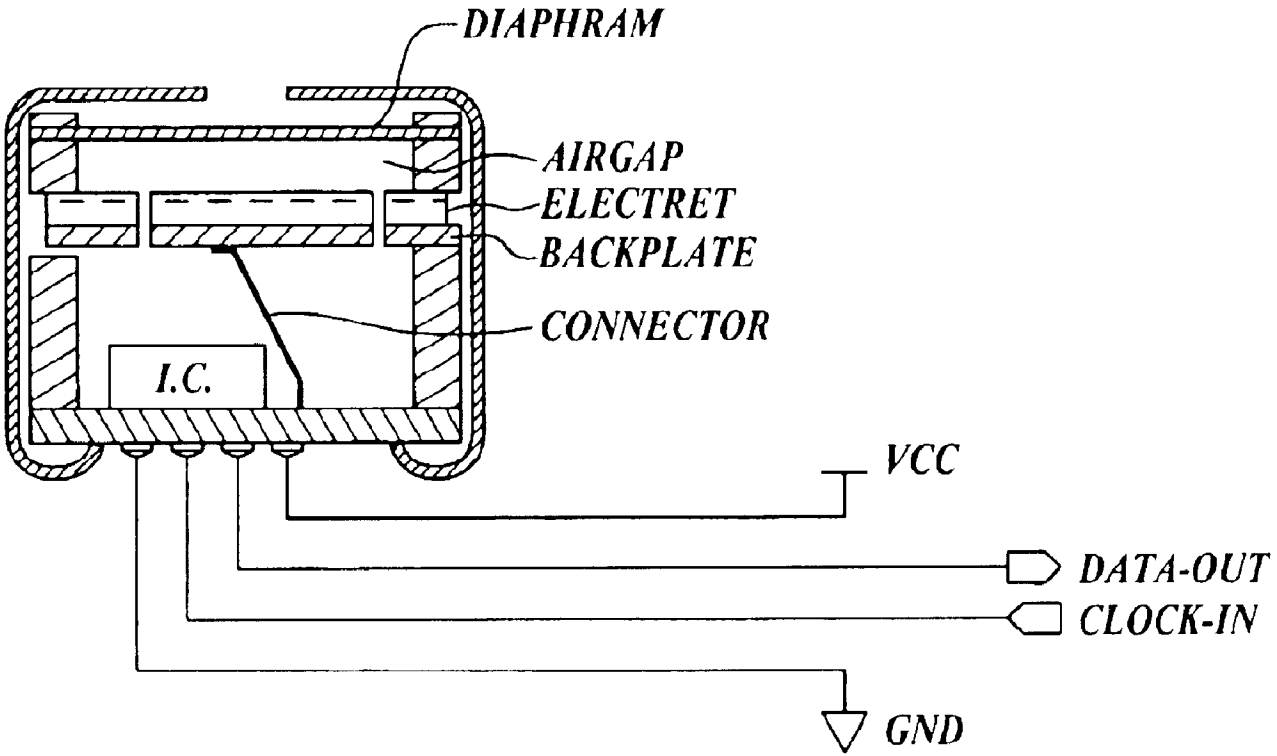
Figure 1 (PRIOR ART)
FIG. 1 is an illustration of an example digital electret condenser microphone.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meaning of "a," "an," and "the" includes plural reference. The meaning of "in" includes "in" and "on." The term "connected" means a direct connection between the items connected, without any intermediate devices. The term "coupled" refers to both direct connections between the items connected, and indirect connections through one or more intermediary items. The term "circuit" may refer to both single components, and to a multiplicity of components. The term component refers to one or more items that are configured to provide a desired function. The term "signal" includes signals such as currents, voltages, charges, logic signals, data signals, optical signals, electromagnetic waves, as well as others.

Briefly stated, a two-wire interface for a digital microphone circuit includes a power line and a ground line. The interface utilizes the ground line as a "voltage active line" to transmit both clock and data signals between the digital microphone circuit and a receiving circuit. The digital microphone circuit detects the clock signal on the voltage active line and uses the detected clock signal to operate an ADC to provide digital data. The digital data is used to selectively drive current back to the receiving circuit over the voltage active line. The receiving circuit detects the transmitted data by monitoring the voltage associated with a line termination. The impedance associated with the line termination is switched by the receiver circuit to modulate the clock signal on the voltage active line.

Example Two-Wire System

Figure 2A:
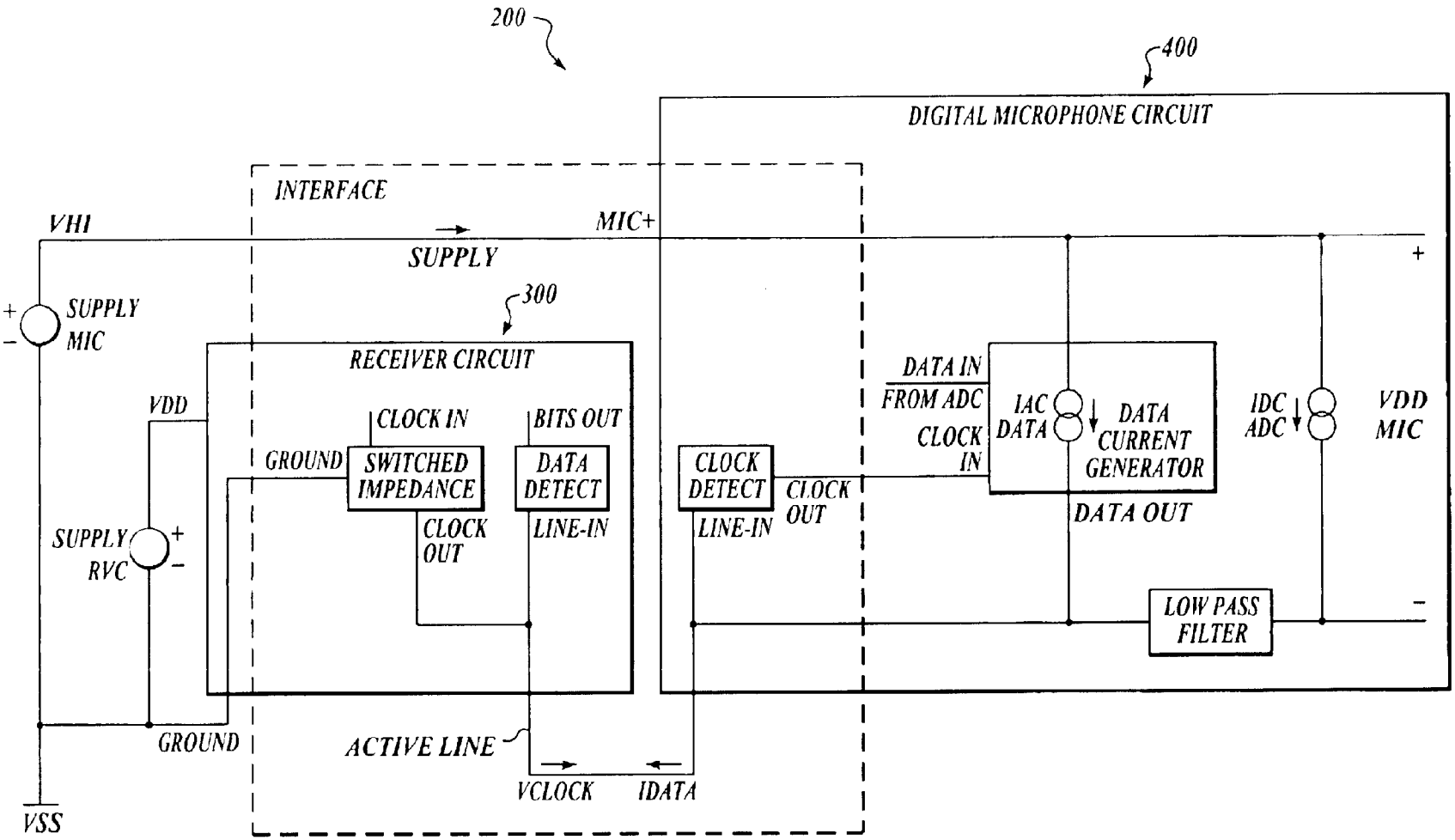
FIG. 2A is a schematic illustration of an example embodiment of the present invention.
Figure 2B:
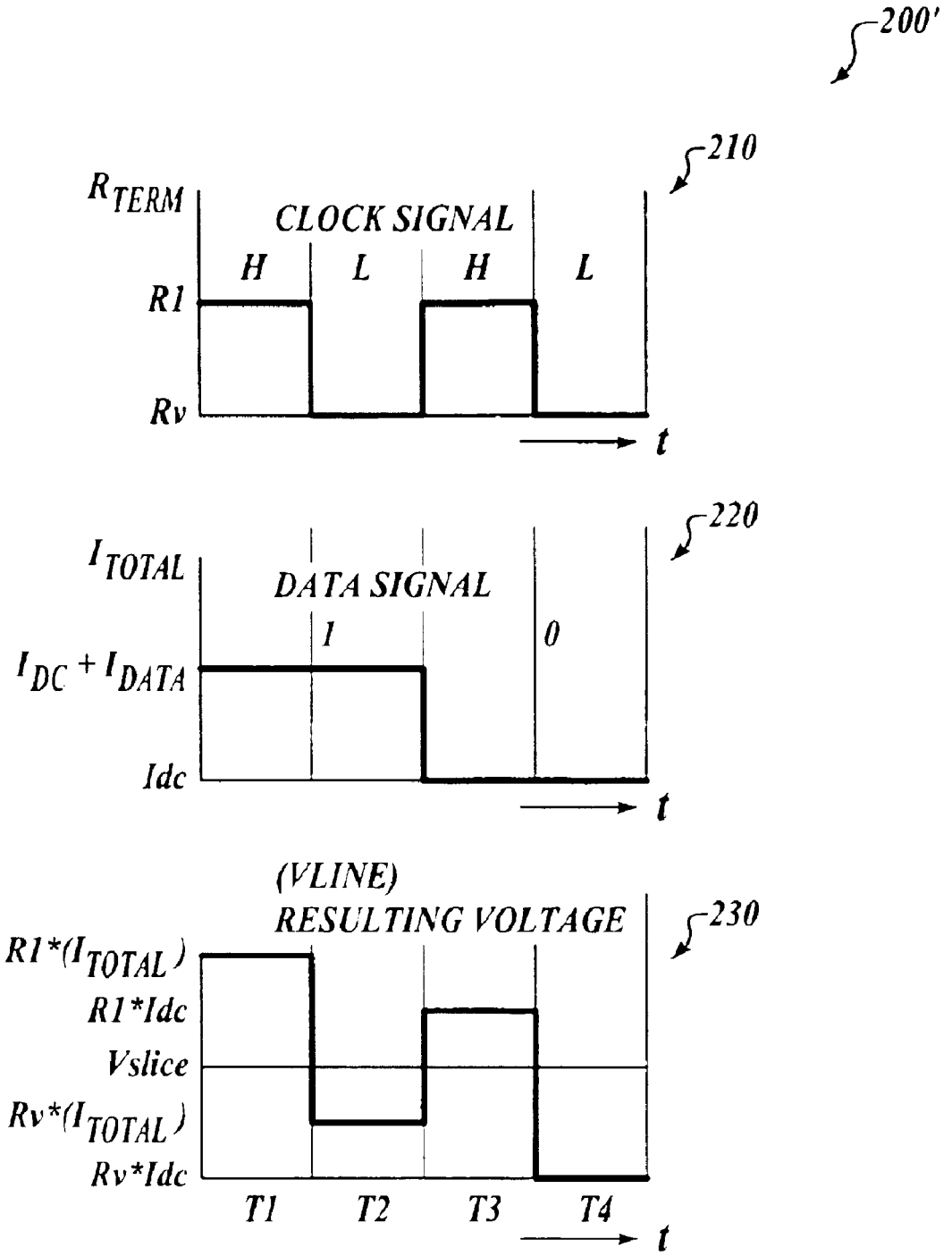
FIG. 2B is a graphical illustration of example signals for the schematic illustrated in FIG. 2A.

FIG. 2A is a schematic illustration (200) of an example embodiment of the present invention. FIG. 2B is a graphical illustration (200') of example signals (210–230) for the schematic illustrated in FIG. 2A. The example system illustrated in FIG. 2A includes two voltage supplies (MIC, RCV), a receiver circuit (300), and a digital microphone circuit (400).

Receiver circuit 300 is powered by the first voltage supply (RCV), which includes VDD and VSS connections. The receiver circuit (300) is coupled to the digital microphone circuit (400) through a single wire, referred to as the "voltage active line". Digital microphone circuit 400 receives a power signal (VHI) from the second voltage supply (MIC), but does not have a direct connection to a ground return on the supply. Instead, the digital microphone circuit (400) is coupled to a ground return path (e.g., VSS) through a line termination that is provided in the receiver circuit.

The receiver circuit (300) includes a data detect circuit and a switched impedance circuit. The data detect circuit is arranged to monitor the voltage associated with the voltage active line. The variations in the voltage on the voltage active line are detected by the data detect circuit as digital signals, which are provided as a stream of digital data bits. The impedance of the line termination in the receiver circuit (300) is modulated by a switched impedance circuit in response to a clock signal (Clock In). The modulation of the switched impedance results in the transmission of a clock signal to the digital microphone circuit (400).

The digital microphone circuit (400) includes a clock detect circuit, a data current generator circuit, a low-pass filter circuit, and an analog-to-digital converter (ADC) circuit. An analog signal source such as an ECM (e.g., see FIG. 1) is in electrical communication with the ADC circuit. The clock detect circuit is arranged to monitor the voltage active line, and provide a clock signal (Clock Out) when the voltage associated with the voltage active line increases above a detection threshold. The clock signal is provide to the data current generator circuit and the ADC circuit by the clock detect circuit. The low pass filter circuit is arranged to: provide a local ground that is isolated from the voltage active line so that perturbations from the voltage active line do not adversely impact the performance of circuits that are coupled to the local ground. For example, the ADC circuit and the microphone are operated from the local ground so that noise signals that result from the clock and data signals on the voltage active line are isolated from the conversion process.

The ADC circuit is arranged to provide digital data (Data In) to the data current generator in response to the analog signal source (e.g., the ECM) when clocked. The data current generator circuit is arranged to drive current ($I_{DATA}$) into the voltage active line in response to the digital data (Data In) when clocked by the clock signal (Clock Out). The ADC circuit draws a relatively constant current ($I_{DC}$) from the digital microphone power supply such that the voltage generated by the line termination is also relatively constant. However, the data current generator circuit will increases the voltage generated by the line termination by driving additional current ($I_{DATA}$) into the voltage active line in response to the digital data (Data In).

The clock signal is recovered by digital microphone circuit (400) from the line voltage ($V_{LINE}$), which is associated with the voltage active line. The total current ($I_{TOTAL}$) that is driven into the line termination will result in a voltage ($V_{LINE}$) on the voltage active line as given by: $V_{LINE}(t)=R_{TERM}(t)*[I_{DC}+I_{DATA}(t)]$, where $R_{TERM}(t)$ corresponds to the impedance of the line termination over time, and $I_{TOTAL}$ corresponds to the sum of $I_{DC}$ and $I_{DATA}$. When the data signal ($I_{DATA}$) is not changing, the line voltage ($V_{LINE}$) will vary directly with variations in the impedance of the line termination ($R_{TERM}$).

In one example, the impedance of the line termination changes between values of $R_1$ and $R_V$ in response to the input clock signal (Clock In), as illustrated by waveform 210 in FIG. 2B. A data signal is modulated on the voltage active line as illustrated by waveform 220 in FIG. 2B. The resulting line voltage ($V_{LINE}$) is given by the product of $I_{TOTAL}$ and $R_{TERM}$ as illustrated by waveform 230 in FIG. 2B. The slice voltage ($V_{SLICE}$) indicates an appropriate detection threshold for which the digital microphone circuit (400) can recover the clock signal.

Example Receiver Circuits

Figure 3A:
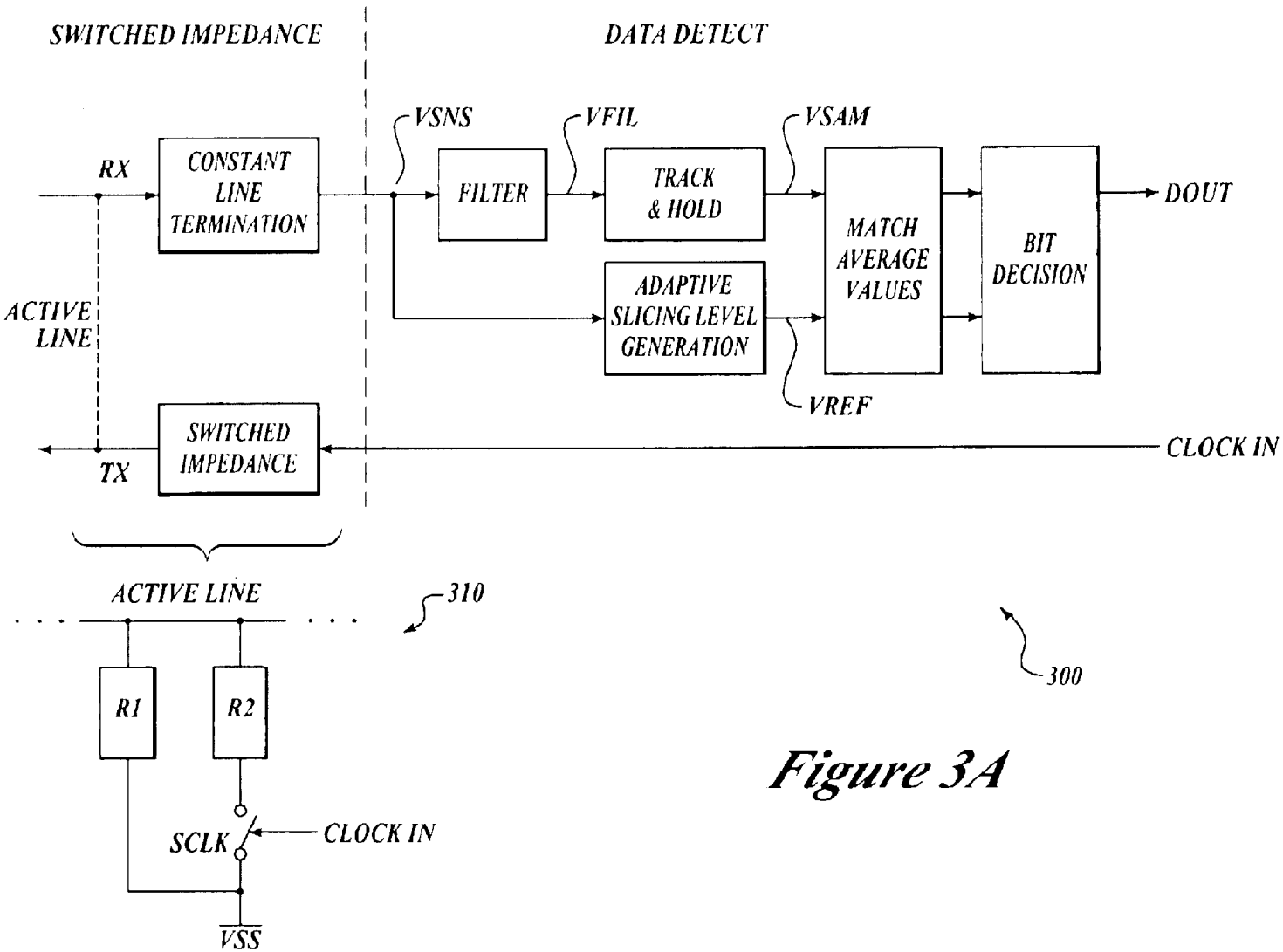
FIG. 3A is a schematic illustration of an example receiver circuit that is arranged in accordance with an embodiment of the present invention.
Figure 3B:
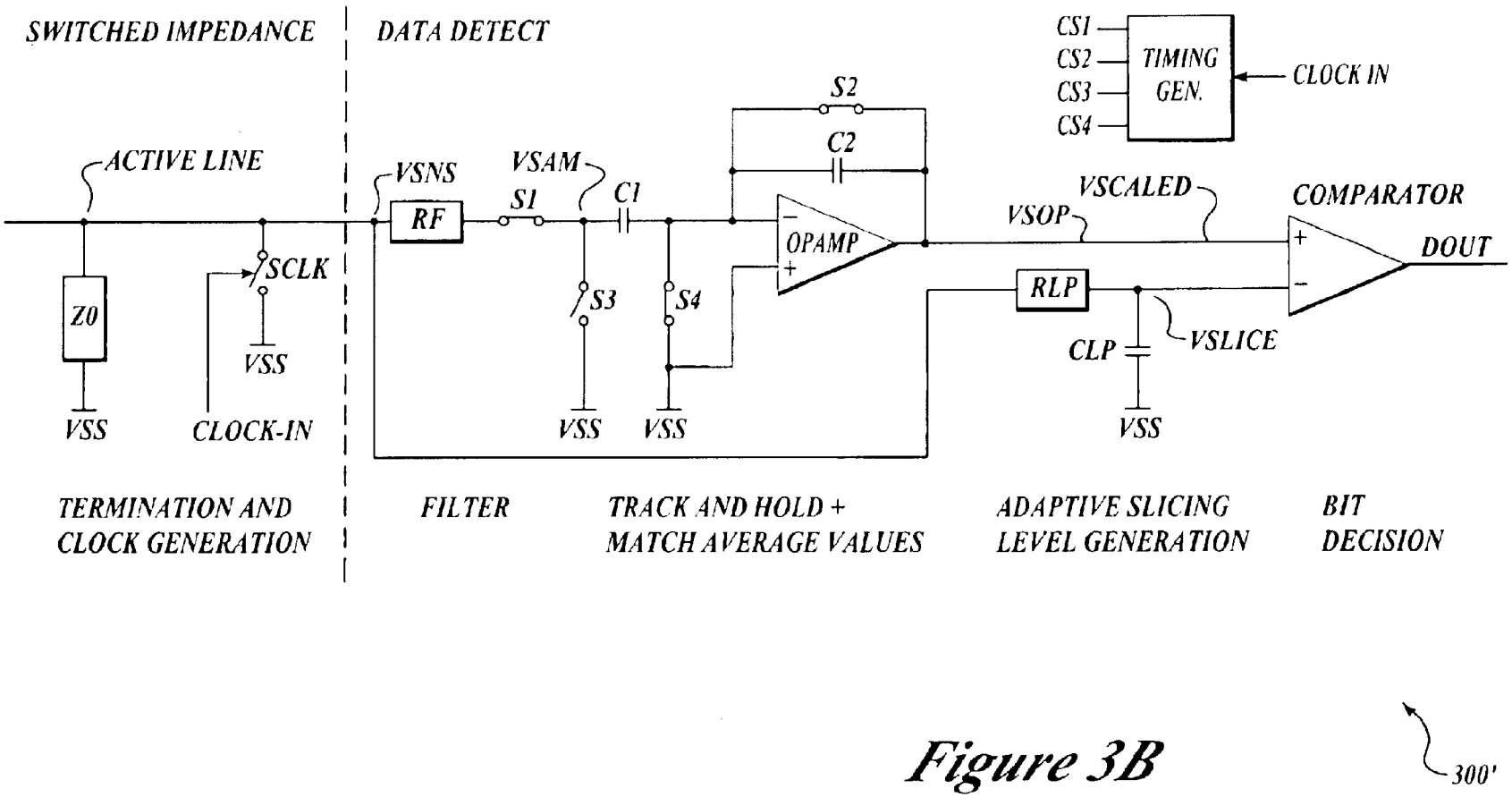
FIG. 3B is a schematic illustration of another example receiver circuit that is arranged in accordance with another embodiment of the present invention.
Figure 3C:
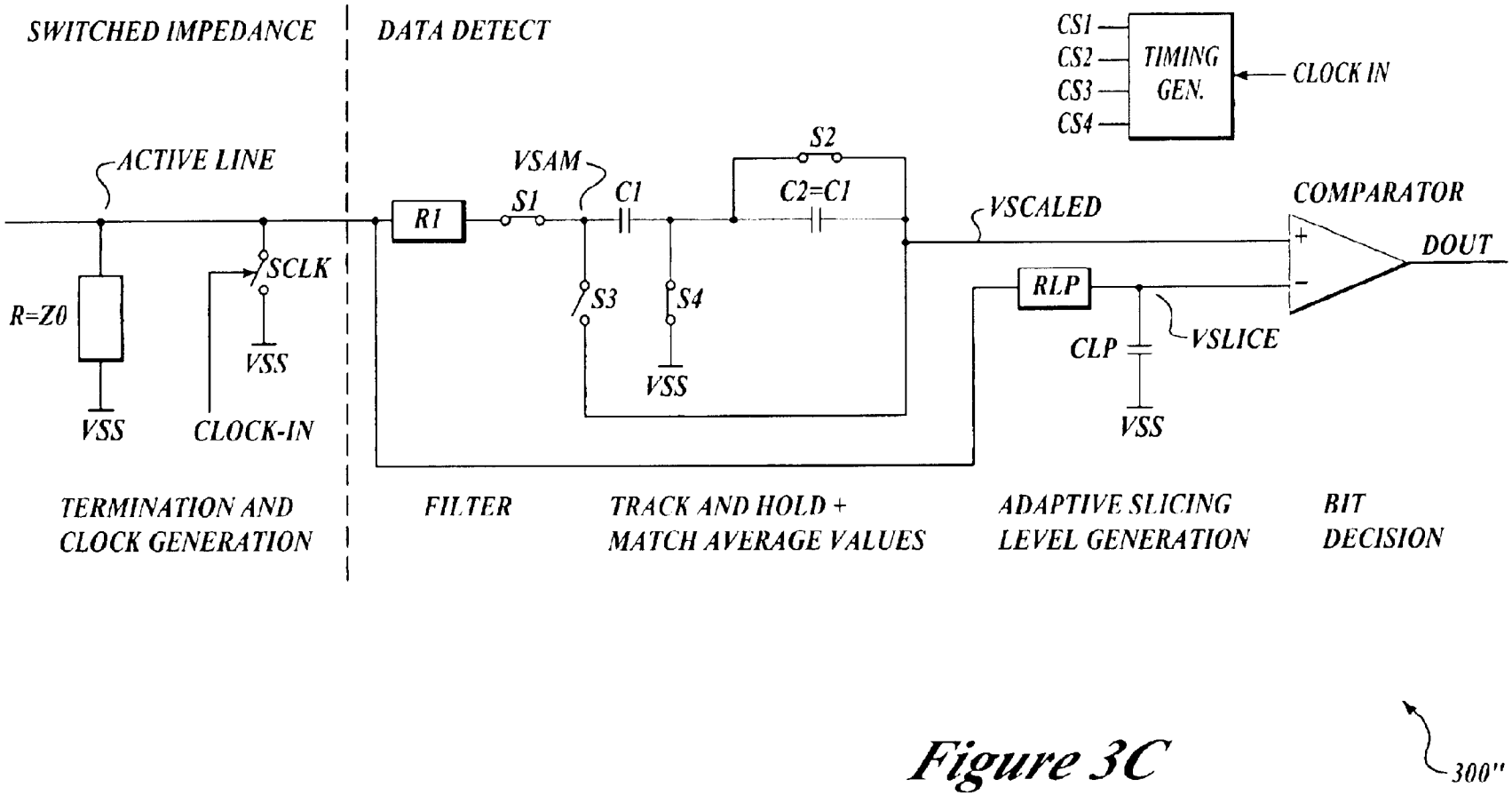
FIG. 3C is a schematic illustration of yet another example receiver circuit that is arranged in accordance with yet another embodiment of the present invention.

FIG. 3A is a schematic illustration of an example receiver circuit (300) that is arranged in accordance with an embodiment of the present invention. Additional example circuits are illustrated in FIGS. 3B and 3C. The various circuits illustrated in FIG. 3A through FIG. 3C are for illustrative purposes, and may be combined and/or separated to provide similar functions.

The example receiver circuit illustrated in FIG. 3A includes a switched impedance portion and a data detect portion. The switched impedance portion includes a constant line termination circuit and a switched impedance circuit. The data detect portion includes a filter circuit, a track & hold circuit, an adaptive slicing level generator, a match average values circuit, and a bit decision circuit.

The constant line termination circuit is arranged to receive current from the line, and provides a sensed signal ($V_{SNS}$). The filter circuit is arranged to receive the sensed signal ($V_{SNS}$) and provide a filtered signal ($V_{FIL}$). The frequency spectrum of the detected signal is limited by the filter such that noise power and high frequency interference is minimized. In one example, the filter can be implemented as a low-pass filter using a resistor and a capacitor. The track & hold circuit is arranged to receive the filtered signal ($V_{FIL}$) and provide a sampled signal ($V_{SAM}$). The signal is sampled based on timing signals such that the line impedance does not change during sampling. The adaptive slicing level generator is arranged to receive the sensed signal ($V_{SNS}$) and provide a slice reference level ($V_{REF}$). The match average values circuit is arranged to receive the sampled signal ($V_{SAM}$) and the slice reference level ($V_{REF}$). The match average values circuit cooperates with the bit decision circuit to determine the bit value that is associated with the sensed signal ($V_{SNS}$). The bit value is provided as a digital output signal ($D_{OUT}$). In one example, the digital output signal is provided as a serial stream of data such as from a 1-bit converter (e.g., a delta-sigma ADC).

The voltage active line from the two-wire interface is used as both a receiver line (RX) and a transmit line (TX). The constant line termination and the switched impedance circuit may be combined into a single circuit as illustrated by circuit 310. The impedance associated with the line termination corresponds to $R_1$ when switching circuit $S_{CLK}$ is in an open-circuit position, while the impedance corresponds to the parallel combination of $R_1$ and $R_2$ when switching circuit $S_{CLK}$ is in a closed-circuit position. Resistor $R_2$ may simply correspond to the closed-circuit switch impedance for switching circuit $S_{CLK}$.

For proper clock recovery in the digital microphone circuit (400), the impedance of the line termination in the receiver circuit (300) and the levels associated with the line current should satisfy the conditions that follow.

$$[R_1(I_{DC}+I_{DATA})]>(R_1*I_{DC})>[R_V*(I_{DC}+I_{DATA})]>(R_V*I_{DC}) \quad (1)$$

$$R_V=(R_1*R_2)/(R_1+R_2) \quad (2)$$

$$(I_{AC}I_{DC})<(R_1/R_2) \quad (3)$$

Since the clock signal is present in the time varying line voltage, the clock signal can be retrieved as described above with reference to FIG. 2B. One possible slice level can be selected as: $V_{SLICE}=\{(R_1*I_{DC})+[R_V*(I_{DC}+I_{DATA})]\}/2$.

FIG. 3B is a schematic illustration of another example receiver circuit (300') that is arranged in accordance with another embodiment of the present invention. Circuit 300' includes: a switched impedance portion and a data detect portion. The switched impedance portion includes a termination and clock generator circuit, while the data detect portion includes a filter circuit that is combined with a track & hold circuit and a match average values circuit, an adaptive slicing level generator, and a bit decision circuit.

The termination and clock generator circuit is arranged similar to that described previously with respect to FIG. 3A. Resistor RF is coupled between the switched impedance circuit and switching circuit $S_1$. Switching circuit $S_1$ is also coupled to switching circuit $S_3$ and capacitor $C_1$. Switching circuit $S_3$ is arranged to selectively couple one plate of capacitor $C_1$ to VSS in response to a timing signal (not shown). Capacitor $C_1$ is also coupled to the non-inverting input of an operational amplifier (Op-amp). The non-inverting input of the op-amp is coupled to VSS.

Switching circuit $S_4$ is coupled between the non-inverting and inverting inputs of the op-amp such that the non-inverting input terminal is coupled to VSS in response to another timing signal (not shown). Capacitor $C_2$ is coupled between the inverting input and the output of the op-amp. Switching circuit $S_2$ is coupled in parallel with capacitor $C_2$ such that capacitor $C_2$ is periodically discharged. Resistor $R_{LP}$ is coupled between the sensed signal ($V_{SNS}$) and the inverting input of a comparator. Capacitor $C_{LP}$ is coupled between the inverting input of the comparator and VSS. The non-inverting input of the comparator is coupled to the output of the op-amp. A timing generator may be included in circuit 300' to provide control signals $CS_1$ through $CS_4$ for timing the actuation of switching circuits $S_1$–$S_4$, respectively.

Resistor $R_F$ and capacitor $C_1$ provide a low pass filter function when switching circuits $S_1$, $S_2$, and $S_4$ are closed, and switching circuit $S_3$ is open. The Op-amp, capacitors $C_1$ and $C_2$, and switching circuit $S_1$ through $S_4$ are arranged to operate as a track and hold circuit. The track and hold circuit is operated in a tracking mode when switching circuits $S_1$, $S_2$, and $S_4$ are closed, and switching circuit $S_3$ is open. Switching circuit $S_4$ and switching circuit $S_2$ are subsequently opened such that the sensed (or tracked) voltage is sampled. Next, switching circuit $S_1$ opens, followed by the closing of switching circuit $S_3$ to force charge redistribution over capacitors $C_1$ and $C_2$. The track and hold circuit is operated in a hold mode while switching circuits $S_1$, $S_2$, and $S_4$ are open, and switching circuit $S_3$ is closed. The sampled voltage (e.g., $V_{SAM}$) is scaled by the ratio of capacitors $C_1$ and $C_2$ such that $V_{OP}=V_{SAM}*(C_1/C_2)$. The sensed voltage ($V_{SNS}$) is not affected the scaled voltage ($V_{OP}$) at the output of the op-amp.

An adaptive slice level ($V_{SLICE}$) is provided at the inverting input of the comparator. The adaptive slice level corresponds to an average value of the sense voltage ($V_{SNS}$), which is averaged by the low pass filter function that is provided by $R_{LP}$ and $C_{LP}$. The comparator is arranged to evaluate the scaled voltage ($V_{OP}$) and provide a digital output ($D_{OUT}$) when the scaled voltage ($V_{OP}$) exceeds the adaptive slice level ($V_{SLICE}$).

When the clock and data signals have a data independent DC component, the average value of the voltage active line will be a linear function of the input current. The impedance of the voltage active line will correspond to $Z_0$ during one operating phase (where switching circuit $S_{CLK}$ is open). During another operating phase (where switching circuit $S_{CLK}$ is closed), the impedance of the voltage active line will correspond to the parallel combination of $Z_0$ and $R_{SW}$, where $R_{SW}$ corresponds to the impedance of switching circuit $S_{CLK}$. The average value of the voltage that is associated with the voltage active line is given by: $V_{SNS,AV}=\{(Z_0*T_1)+[(Z_0\|R_{SW})*T_2]\}*\{I_{DC}+(T_3*I_{DATA,MAX})\}/\{T_1+T_2\}$, where $T_1$ and $T_2$ correspond to the time periods for which the impedance is selected in each respective operating phase, and $T_3$ is the amount of time that the data is on the voltage active line. Assuming a 50% duty cycle ($T_1=T_2$), the average value of the voltage associated with the voltage active line corresponds to: $V_{SNS,AV}=\{(Z_0+(Z_0\|R_{SW})\}*\{I_{DC}+(0.5*I_{DATA,MAX})\}/2$.

In one example, sampling is initiated at the end of the clock period where switching circuit $S_{CLK}$ is open. For this example, the sensed voltage ($V_{SNS}$) for a logic 0 is given by: $V_{SNS,0}=Z_0*I_{DC}$, and the sensed voltage ($V_{SNS}$) for a logic 1 is given by: $V_{SNS,1}=Z_0*(I_{DC}+I_{DATA,MAX})$. The ideal slicing level ($V_{SL}$) corresponds to the midpoint between $V_{SNS,0}$ and $V_{SNS,1}$, as given by: $V_{SL}=Z_0*\{I_{DC}+(I_{DATA,MAX}/2)\}$.

The average value of the voltage ($V_{SNS,AV}$) associated with the voltage active line differs from the ideal slicing level ($V_{SL}$) by a correction factor (A) that is given by: $A=\{Z_0+(Z_0\|R_{SW})\}/\{2*Z_0\}$. Resistor $R_{LP}$ and capacitor $C_{LP}$ are arranged as a low-pass filter function that provides the average vale of the line voltage ($V_{SNS,AV}$) as the adaptive slice level ($V_{SLICE}$) to the inverting input of the comparator. The op-amp circuit is arranged to sufficient gain to the sampled signal ($V_{SAM}$) such that the scaled signal ($V_{OP}$) accounts for the correction factor (A).

In one example, the switch resistance ($R_{SW}$) corresponds to approximately zero ohms, the correction factor (A) corresponds to 0.5. For this example, the op-amp circuit is arranged to provide a gain of 0.5 such that the comparator makes appropriate bit decisions based on the adaptive slice level ($V_{SLICE}$).

FIG. 3C is a schematic illustration of yet another example receiver circuit (300") that is arranged in accordance with yet another embodiment of the present invention. The circuit from FIG. 3B is substantially similar to that illustrated in FIG. 3C. However, the switched-capacitor amplifier arrangement from FIG. 3B is replaced by a simple parallel capacitor pair. During a tracking phase capacitor C, forms a low-pass filter with resistor $R_1$ through switching circuits $S_1$ and $S_4$, where the input signal from the voltage active line is tracked. At the end of the tracking phase, capacitor $C_2$ is switched in parallel with capacitor $C_1$ via switching circuit $S_3$ such that charge stored on capacitor $C_1$ from the first tracking phase is redistributed to the paralleled capacitors. When capacitors $C_1$ and $C_2$ have equal values, the scaled output voltage ($V_{SCALED}$) corresponds to half of the sampled voltage ($V_{SAM}$).

Other sampling circuits may be employed in place of the track and hold implementations that are described with respect to FIGS. 3B and 3C. For example, a sample-and hold circuit may be employed that prevents the signal at the input of the bit decision circuit from changing until the next sample is acquired. Also, the bit decision circuit may be modified such that the digital output signal does not change until enabled by another control signal (e.g., a clock signal).

Example Digital Microphone Circuits

Figure 4A:
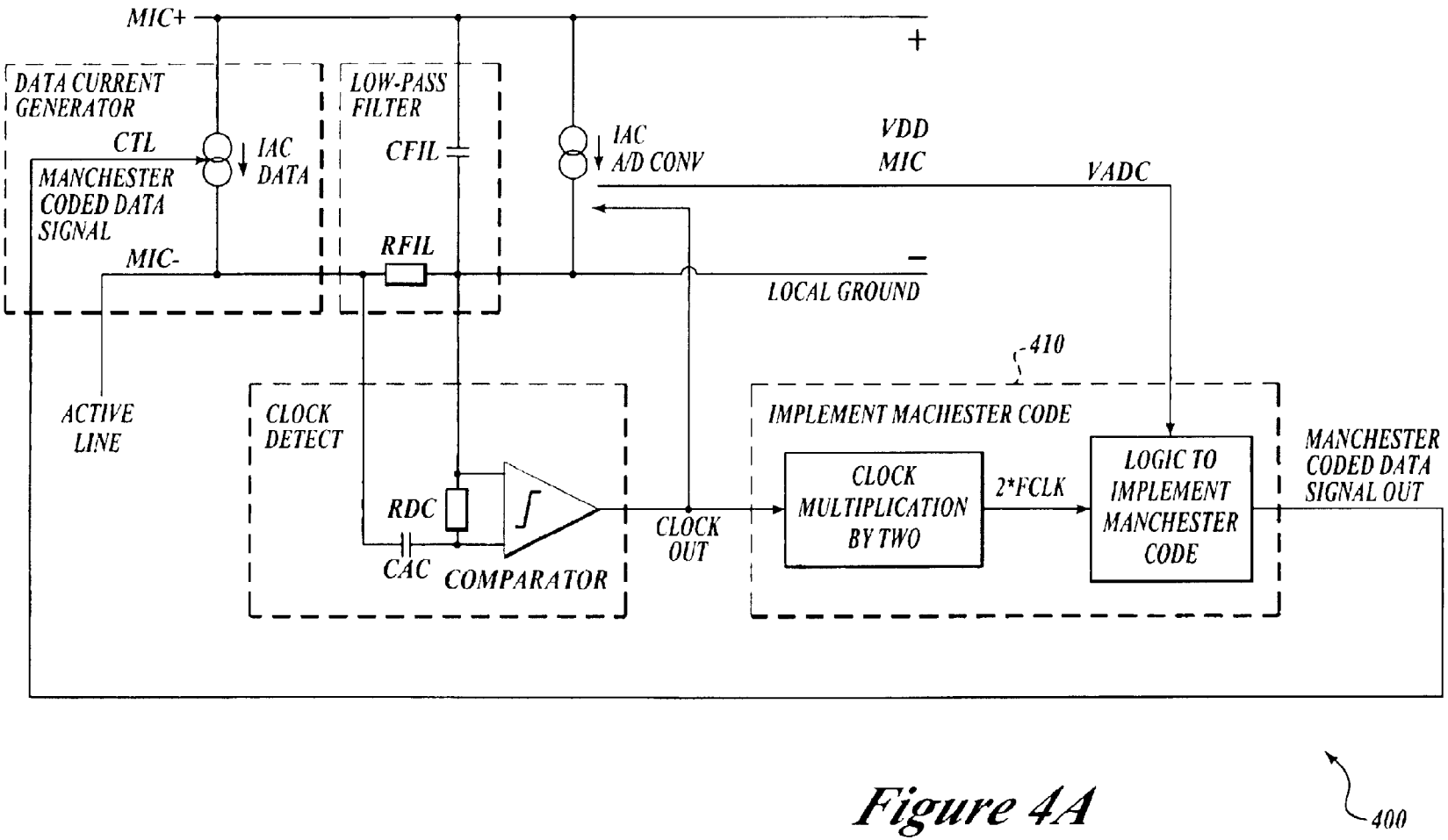
FIG. 4A is a schematic illustration of an example digital microphone circuit that is arranged in accordance with an embodiment of the present invention.

FIG. 4A is a schematic illustration of an example digital microphone circuit that is arranged in accordance with an embodiment of the present invention.

Figure 4B:
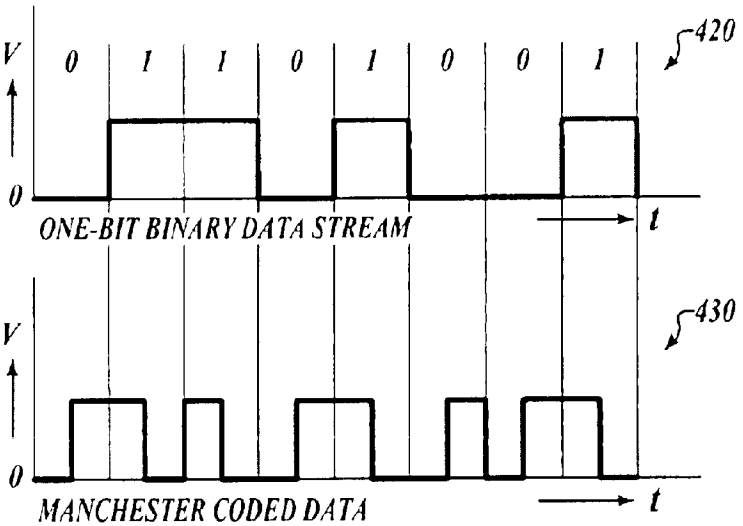
FIG. 4B is an illustration of an example Manchester encoder that is arranged in accordance with an embodiment of the present invention.
Figure 4B:
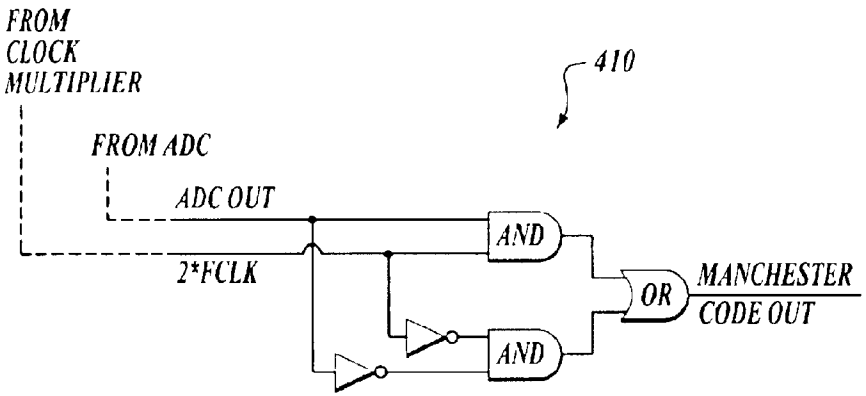

FIG. 4B is an illustration of an example Manchester encoder that is arranged in accordance with an embodiment of the present invention. The various circuits illustrated in FIG. 4A through FIG. 4B are for illustrative purposes, and may be combined and/or separated to provide similar functions.

The digital microphone circuit (400) that is illustrated in FIG. 3A is substantially similar to that described with respect to FIG. 2A. The digital microphone circuit (400) includes a clock detect circuit, a data current generator circuit, a low-pass filter circuit, and an analog-to-digital converter (ADC) circuit. Digital microphone circuit 400 also includes an optional Manchester encoder circuit for encoding the digital data from the ADC as a current on the voltage active line.

The ADC circuit is represented as a current source that is coupled between the power supply (e.g., +MIC) and a local ground. The ADC circuit draws a relatively constant current that is represented as $I_{DC}$ The ADC circuit is responsive to a clock signal such as CLOCK OUT, and provides an ADC output signal (e.g., $V_{ADC}$) by converting signals from a microphone (e.g., see FIG. 1) to a digital quantity. In one example, the ADC circuit is a 1-bit converter such as a delta-signal converter.

The low-pass filter circuit is illustrated as a resistor ($R_{FIL}$) and a capacitor ($C_{FIL}$). Resistor $R_{FIL}$ is coupled between the voltage active line and the local ground. Capacitor $C_{FIL}$ is coupled between the power supply (e.g., +MIC) and the local ground. Resistor $R_{FIL}$ isolates the voltage active line from the local ground, while capacitor $C_{FIL}$ decouples the supply for the digital microphone circuit by rolling off high-frequencies. Resistor $R_{FIL}$ and capacitor $C_{FIL}$ are arranged in cooperation to provide a low-pass filter function such that clock and data signals from the voltage active line are filtered out of the local ground for the digital microphone.

The clock detect circuit is represented as a resistor ($R_{DC}$), a capacitor ($C_{AC}$), and a comparator circuit. Resistor $R_{DC}$ is coupled between first and second inputs of the comparator circuit. Capacitor $C_{AC}$ is coupled between the voltage active line and the first input of the comparator circuit such that the line voltage is AC coupled to the comparator. The second input of the comparator circuit is coupled to the local ground such that the comparator circuit compares the AC coupled line voltage from the voltage active line to the local ground voltage. Resistor $R_{DC}$ is arranged to provide a DC level to the first input of the comparator circuit, and is typically high ohmic. Since capacitor $C_{AC}$ is configured to AC couple signals to the comparator circuit, any appropriate DC level can be used as a reference. For example, a voltage reference that is different from the local ground voltage can be coupled to the comparator circuit.

A clock signal is transmitted to the digital microphone circuit over the voltage active line by modulating the impedance associated with the line termination, as previously described. Each variation in the line impedance results in a line voltage variation. The line voltage variations are AC coupled to the comparator via capacitor $C_{AC}$ such that the clock signal is a detected clock signal is provided at the output of the comparator circuit as CLOCK OUT.

The data current generator circuit is illustrated as a current source that is coupled between the power supply (e.g., +MIC) and the voltage active line. The data generator circuit is arranged to provide a data current signal ($I_{DATA}$) on the voltage active line in response to a control signal (CTL). The control signal is responsive to the ADC output signal (e.g., $V_{ADC}$). In one example, the ADC output signal is directly coupled to the control terminal of the data current generator circuit. In another example, the ADC output signal is indirectly coupled to the control terminal of the data current generator circuit through intermediary circuitry.

In one example, the ADC output signal is indirectly coupled to the control terminal of the data current generator circuit via a Manchester encoding circuit that includes a clock multiplier circuit and a logic circuit. The clock multiplier circuit is arranged to provide a clock signal that has a frequency that is approximately double the frequency that is associated with the signal CLOCK OUT. The logic circuit is arranged to receive the ADC output signal (e.g., VADC) and the double clock signal, and provide the control signal (CTL) as a Manchester encoded control signal.

An example logic circuit for Manchester encoding the control signal is illustrated in FIG. 4B by circuit 410. Circuit 410 includes two inverters logic gates, two AND logic gates, and an OR logic gate. The first AND logic gate is arranged to receive the ADC output signal and the double clock signal. The first inverter logic gate is arranged to provide an inverse of the ADC output signal, while the second inverter logic gate is arranged to provide an inverse of the double clock signal. The second AND logic gate is arranged to receive the inverse ADC output signal and the inverse double clock signal. The OR logic gate is arranged to receive the outputs of the first and second AND logic gates to provide the Manchester encoded control signal.

Other circuits can be employed to accomplish Manchester encoding. In one example, the clock multiplier circuit is replaced with a clock divider circuit. For this example, the clock signal that is provided on the voltage active line corresponds to twice the frequency that is described previously.

An example binary data stream is illustrated as waveform 420, where each logical zero is represented by 0V and each logical one is represented as a non-zero voltage. A Manchester encoded signal is illustrated as waveform 430. The Manchester encoder circuit encodes a "digital one" as the symbol "one-zero", while a "digital zero" is encoded by the symbol "zero-one". Other Manchester encoding circuits may be employed that provide similar functionality. The data current generator is illustrated as a voltage-controlled current-source that generates the data current ($I_{DATA}$) in response to the Manchester encoded control signal.

Example System Waveforms

Figure 5:
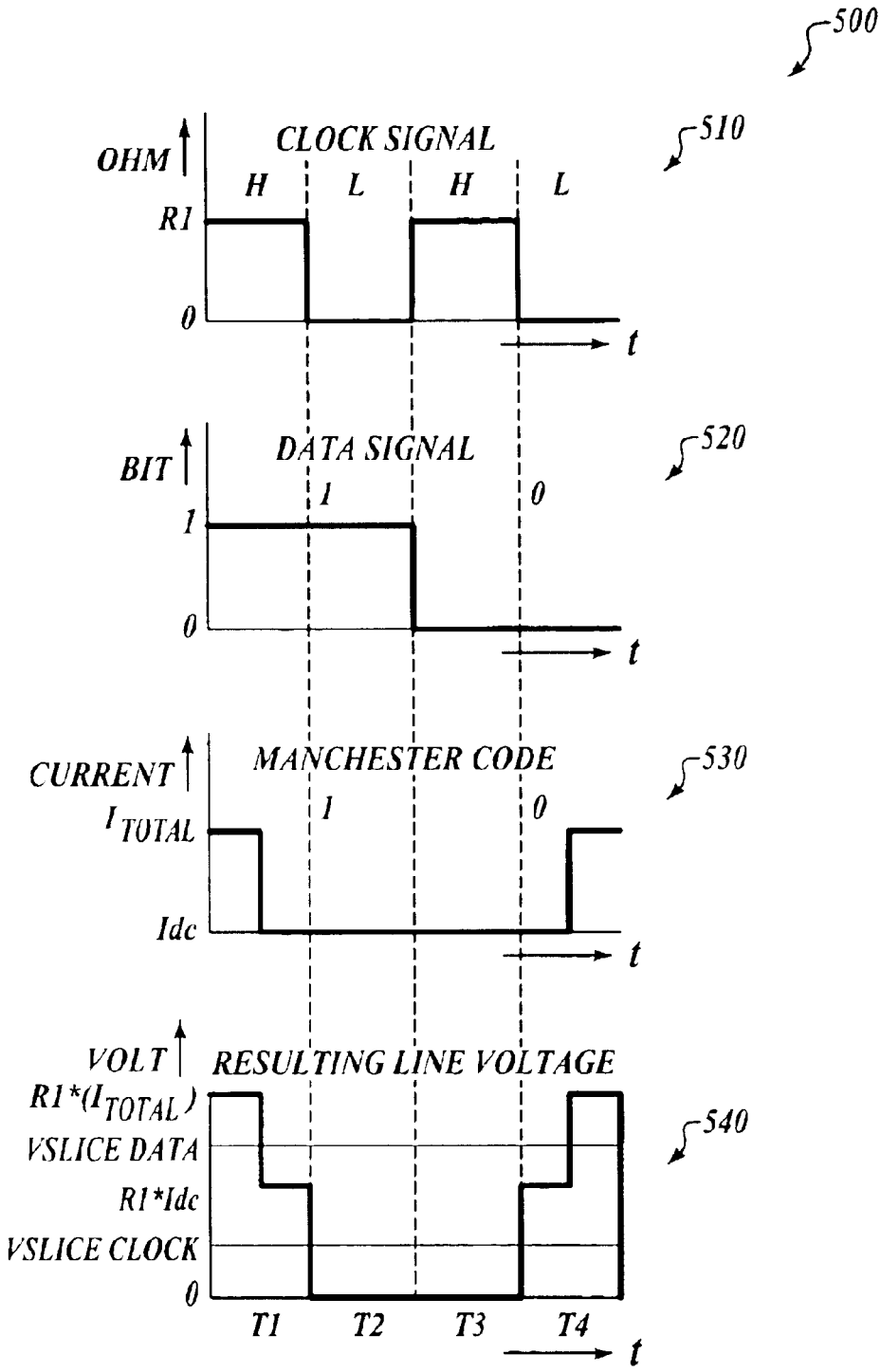
FIG. 5 is a graphical illustration of example signals for a system that is arranged in accordance with an embodiment of the present invention.

FIG. 5 is a graphical illustration of example signals (500) for a system that is arranged in accordance with an embodiment of the present invention.

Signal 510 illustrates the switching of the line impedance between RI and zero ohms to modulate a clock signal on the voltage active line. Signal 520 illustrates the ADC output signal as a serial bit stream. Signal 530 illustrates a Manchester encoded data signal that modulates the current on the voltage active line in response to the ADC output signal. Signal 540 illustrates the resulting line voltage that is associated the voltage active line when modulated with a current data signal that is Manchester encoded. As illustrated by signal 540, the slice level that is used to detect data from the voltage active line is different from the slice level that is used to detect the clock signal.

A typical digital microphone may include four digital connections as illustrated in FIG. 1. Although the digital microphone performs with better signal-to-noise performance than an analog microphone, the digital microphone requires a special connection interface. A two-wire (or two-line) interface is preferable because of various considerations such as the availability of two-wire connectors, reduced manufacturing costs, to name a few. The present invention provides a two-line interface, where one of the lines provides a power signal, and the other line operates as: a ground return, a clock line, and a data line for the digital microphone circuit. The digital microphone circuit can be arranged to communicate with a base-band circuit such as in a cellular telephone, or some other receiving circuit in an electronic system.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An apparatus for interfacing a microphone, comprising:

a receiver circuit that includes a first ground terminal and a line terminal, wherein the receiver circuit is arranged to couple the line terminal to the first ground terminal through a line termination impedance; and a digital microphone circuit that includes a second ground terminal and a power terminal, wherein the second ground terminal is coupled to the line terminal by a voltage active line, the digital microphone circuit comprising:

a local ground, wherein the microphone is coupled between the power terminal and the local ground;

an analog-to-digital converter circuit is coupled between the power terminal and the local ground, wherein the analog-to-digital converter circuit is arranged to provide an ADC output signal that is responsive to the microphone;

a clock detect circuit that is arranged to coupled to the voltage active line and arranged to provide a detected clock signal, wherein the detected clock signal is coupled to the analog-to-digital converter and a data current generator; and a data current generator circuit is coupled to between the power terminal and the second ground terminal, wherein the data current is arranged to provide a data signal to the voltage active line in response to the ADC output signal.

2. The apparatus of claim 1, the receiver circuit comprising: a data detect circuit that is arranged to detect the data signal.

3. The apparatus of claim 2, wherein the data signal is a current that is coupled to ground through the line termination impedance such that a voltage associated with the line terminal is associated with the data signal.

4. The apparatus of claim 2, the data detect circuit comprising:

a filter circuit that is arranged to filter a signal that is associated with the line terminal to provide a filtered signal;

a track and hold circuit that is arranged to sample the filtered signal to provide a sampled signal; and a bit decision circuit that is arranged to provide a digital output signal in response to a comparison between the sampled signal and a reference level.

5. The apparatus of claim 2, the data detect circuit comprising:

a first switching circuit that is coupled between a first node and a second node;

a second switching circuit that is coupled between a third node and a fourth node;

a third switching circuit that is coupled between the second node and the fourth node;

a fourth switching circuit that is coupled between the third node and the first ground terminal;

a first capacitor that is coupled between the second node and the third node; and a second capacitor that is coupled between the third node and the fourth node.

6. The apparatus of claim 5, the data detect circuit further comprising: a first resistor that is coupled between the line terminal and the first node, wherein the first resistor and the first capacitor form a low-pass filter circuit when the first switching circuit and the fourth switching circuit are operated in a closed position, and wherein the first capacitor is arranged to sample the voltage associated with the line terminal.

7. The apparatus of claim 5, the data detect circuit further comprising: an operational amplifier that includes an inverting input that is coupled to the third node, a non-inverting input that is coupled to the first ground terminal, and an output that is coupled to the fourth node, wherein a gain that is associated with the fourth node is adjusted by changing the relative values of the first and second capacitors.

8. The apparatus of claim 2, the data detect circuit further comprising: an adaptive slice level generator circuit and a bit decision circuit, wherein the adaptive slice level generator circuit is arranged to provide a slice level that corresponds to an average voltage that is associated with the line terminal, and wherein the bit decision circuit is arranged to compare a sampled voltage that is associated with the line terminal to the slice level.

9. The apparatus of claim 8, wherein the adaptive slice level generator circuit includes a resistor and a capacitor that are arranged to operate as a low pass filter.

10. The apparatus of claim 8, wherein the bit decision circuit includes a comparator circuit that is arranged to provide a digital output in response to a comparison between the slice level and the sampled voltage.

11. The apparatus of claim 1, the receiver circuit comprising: a switched impedance circuit that is arranged to change the line termination impedance in response to a clock signal.

12. The apparatus of claim 11, wherein the analog-to-digital converter circuit is arranged to provide a relatively constant DC current to the line termination impedance such that a voltage that is associated with the voltage active line is responsive to the clock signal.

13. The apparatus of claim 11, the switched impedance circuit comprising a constant line termination that is coupled between the line terminal and the first ground terminal, and a switching circuit that is responsive to the clock signal, wherein the switching circuit is coupled in parallel with the constant line termination.

14. The apparatus of claim 1, the digital microphone circuit further comprising: a low pass filter circuit that is coupled between the local ground and the second ground terminal, wherein the low-pass filter circuit is arranged to isolate the local ground from the second ground terminal such that the local ground is not disturbed by clock and data signals on the voltage active line.

15. The apparatus of claim 1, the clock detect circuit further comprising: a resistor that is coupled between the local ground and an intermediate node, a capacitor that is coupled between the voltage active line and the intermediate node, and a comparator circuit that includes inputs that are coupled to the intermediate node and the local ground, and an output that is arranged to provide the detected clock signal.

16. The apparatus of claim 1, the clock detect circuit further comprising: a Manchester encoder circuit that is arranged to receive the clock signal and the ADC output signal and provide a control signal to the data current generator circuit such that the data current generator circuit provides a data current to the voltage active line that is Manchester encoded.

17. An apparatus for interfacing a microphone, comprising:

a means for converting, wherein the means for converting is arranged to provide digital control signals in response to analog signals from the microphone, wherein the means for converting also provides relatively constant current to a voltage active line;

a means for modulating, wherein the means for modulating is arranged to provide a modulated current on the voltage active line in response to the digital control signals;

a means for terminating, wherein the means for terminating is arranged to adjust a termination impedance that is associated with the voltage active line in response to the clock signal such that a voltage associated with the voltage active line includes a portion that is related to the clock signal;

a means for clock detecting, wherein the means for clock detecting is arranged to provide a detected clock signal by comparing the line voltage to a clock slice level, wherein the detected clock signal is utilized by the means for modulating and the means for converting;

a means for data detecting, wherein the means for data detecting is arranged to detect a data signal by comparing the line voltage to a data slice level.

18. An apparatus as in claim 17, further comprising a means for encoding, wherein the means for encoding is arranged to receive the detected clock signal and the digital control signals, and provide an encoded control signal, wherein the means for modulating is responsive to the encoded control signal such that the modulated current is also encoded.

19. The apparatus of claim 18, wherein the modulated current is Manchester encoded.

20. An apparatus for interfacing a microphone, comprising:

a constant line termination circuit that is arranged to terminate a voltage active line to a circuit ground;

a switched impedance circuit that is arranged to change the line termination in response to a clock signal such that a line voltage associated with the voltage active line varies according to the line termination;

a sample and hold circuit that is arranged to provide a sampled line voltage from the line voltage;

an adaptive slice level generator circuit that is arranged to generate a data slice level from the line voltage;

a bit decision circuit that is arranged to provide a data output signal by comparing the sampled line voltage from the data slice level;

an analog-to-digital converter circuit that is arranged to provide an ADC output signal in response to signals from the microphone;

a low-pass filter circuit that is arranged to isolate a local ground from the voltage active line, wherein the power return for analog-to-digital converter flows through the low-pass filter circuit to the voltage active line, and wherein the local ground corresponds to a clock slice level;

a data current generator circuit that is arranged to provide a modulated data signal to the voltage active line in response to the ADC output signal; and a clock detect circuit that is arranged to provide a detected clock signal by comparing AC variations in the line voltage to the clock slice level, wherein the detected clock signal is utilized by the analog-to-digital converter circuit and the data current generator circuit.

* * * * *